US007911488B2

(12) United States Patent
Lee et al.

(10) Patent No.: US 7,911,488 B2
(45) Date of Patent: Mar. 22, 2011

(54) ION PRINT HEAD AND IMAGE FORMING APPARATUS USING THE SAME

(75) Inventors: Sang-hoon Lee, Seongnam-si (KR); Hyun-surk Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1632 days.

(21) Appl. No.: 11/194,693

(22) Filed: Aug. 2, 2005

(65) Prior Publication Data

US 2006/0050132 A1 Mar. 9, 2006

(30) Foreign Application Priority Data

Sep. 9, 2004 (KR) ..... 10-2004-0072076

(51) Int. Cl.
*B41J 2/415* (2006.01)

(52) U.S. Cl. ..... 347/123

(58) Field of Classification Search ..... 347/111, 347/112, 120, 123
See application file for complete search history.

(56) References Cited

U.S. PATENT DOCUMENTS 5,406,314 A * 4/1995 Kuehnle ..... 347/115
5,765,073 A 6/1998 Schoenbach et al.
6,184,909 B1 * 2/2001 Matsuno et al. ..... 347/115
6,203,758 B1 3/2001 Marks et al.
6,486,609 B1 * 11/2002 Shiratori et al. ..... 315/169.3

FOREIGN PATENT DOCUMENTS

| | | |
|---|---|---|
| JP | 04-22678 | 1/1992 |
| JP | 09-109435 | 4/1997 |
| KR | 1999-29575 | 4/1999 |
| KR | 2000-51364 A | 8/2000 |
| KR | 2001-102528 | 11/2001 |

OTHER PUBLICATIONS

Korean Office Action dated Feb. 28, 2006 issued in KR 2004-72076.

* cited by examiner

*Primary Examiner* — Huan H Tran
(74) *Attorney, Agent, or Firm* — Stanzione & Kim LLP

(57) ABSTRACT

An ion print head and image forming apparatus using the same includes at least one discharge cell array structure having microelectrodes to form an electrostatic latent image on an insulation layer of an electrostatic drum by selectively applying charged particles to the insulation layer. The at least one discharge cell is provided with a plurality of discharge elements to emit the charged particles, and a controller to control the plurality of discharge elements. Each of the plurality of discharge elements includes a base, a microelectrode disposed on the base to emit the charged particles toward the insulation layer, and a control electrode spaced apart from the base and having a hole therein through which the emitted charged particles pass and to control the emission of the charged particle from the microelectrode.

45 Claims, 4 Drawing Sheets

ION PRINT HEAD AND IMAGE FORMING APPARATUS USING THE SAME

CROSS-REFERENCE TO RELATED APPLICATIONS

This application claims priority from Korean Patent Application No. 2004-72076, filed on Sep. 9, 2004, in the Korean Intellectual Property Office, the disclosure of which is incorporated herein its entirety by reference.

BACKGROUND OF THE INVENTION

1. Field of the Invention

The present general inventive concept relates to an ion print head and an image forming apparatus using the same, and more particularly, to an ion print head in which a discharge cell array structure having microelectrodes is employed, and a image forming apparatus using the same.

2. Description of the Related Art

In a conventional image forming apparatus, a charged photoconductor is exposed to a laser beam, thereby forming a latent image on an image forming part. A toner is supplied between the photoconductor and a development roller to selectively adhere the toner on the image forming part according to an electrostatic property thereof. Herein, the development roller engages the photoconductor but has a different electrostatic potential than the photoconductor. Since the conventional image forming apparatus uses laser beams, a laser scanning unit is required to expose the photoconductor. However, the laser scanning unit requires a precise optical arrangement. Additionally, the laser scanning unit is expensive.

In an attempt to avoid these disadvantages associated with the conventional image forming apparatus that used the laser scanning unit, a printer with a conventional ion print head is disclosed in U.S. Pat. No. 5,406,314. The printer with the conventional ion print head of U.S. Pat. No. 5,406,314 is illustrated in FIGS. 1 and 2.

FIG. 1 is a schematic sectional view illustrating a printer that uses a conventional ion print head. Referring to FIG. 1, the printer includes an image cylinder 15 having a conductive layer 17 and a dielectric layer 16, and erase lamp 14, an electronic writing head 30 for charging the image cylinder 15 to have a predetermined pattern that corresponds to a latent image according to control exerted by a controller, an ink-supply roller 12 in contact with the image cylinder 15 for supplying ink while rotating, a transfer roller 18 for transferring the latent image formed on the image cylinder 15 to a printing medium 10, and a heating element 21 and a hot roller 23 for fusing the transferred image on the printing medium 10. A printing operation performed by the printer is as follows: the electronic writing head 30 forms the latent image having the predetermined pattern on the image cylinder 15, the ink-supply roller 12 supplies ink to the image cylinder 15, the supplied ink adheres on a latent image area of an outer surface of the image cylinder 15 to form an ink image thereon. The transfer roller 18 then transfers the ink image of the image cylinder 15 to the printing medium 10, which passes between the image cylinder 15 and the transfer roller 18. The heating element 21 and the hot roller 23 then fuse the transferred image on the printing medium 10.

FIG. 2 is a schematic sectional view illustrating the electronic writing head 30 of the conventional ion print head of FIG. 1.

Referring to FIG. 2, the electronic writing head 30 includes an insulating body 31, a needle electrode 35, a wraparound electrode 37, and a power supply 39 for supplying voltage pulses to the needle electrode 35. The insulating body 31 is spaced apart from the dielectric layer 16 in a perpendicular direction and has a tunnel 31*a* disposed therein. The needle electrode 35 is formed on an inside wall of the tunnel 31*a* and has a leading end pointing toward an opposite inner wall of the tunnel 31*a*. The wraparound electrode 37 is formed at a portion of the tunnel 31*a* that is adjacent to the dielectric layer 16.

Accordingly, when a voltage pulse is applied to the needle electrode 35, gas molecules in the proximity of the needle electrode 35 lose at least one electron under the influence of a strong electrostatic field created by the needle electrode 35. The electrons are then absorbed by the needle electrode 35. Positive ions from the gas molecules that lose at least one electron tend to migrate away from the needle electrode 35 to a lower electrical potential at a bottom portion of the tunnel 31*a* where the positive ions encounter and are neutralized by the wraparound electrode 37. The positive ions are more strongly attracted to the conductive layer 17 than by the wraparound electrode 37 because an electric potential of the conductive layer 17 is more negative than is an electric potential of the wraparound electrode 37. Thus, the positive ions can be accumulated on the dielectric layer 16 to form the latent image thereon.

The disadvantage of the conventional ion print head of the printer is that the needle electrode 35 in the insulating body 31 is arranged in a radial direction of the image cylinder 15 and the wraparound electrode 37 is additionally provided at the bottom of the tunnel 31*a*, thereby increasing complexity of the electronic writing head 30. Additionally, the process of accumulating the positive ions on the dielectric layer 16 of the image cylinder 15 is complicated.

SUMMARY OF THE INVENTION

The present general inventive concept provides an ion print head and an image forming apparatus using the same including at least one discharge cell array structure having microelectrodes. The ion print head and the image forming apparatus using the same can be simply constructed.

Additional aspects of the present general inventive concept will be set forth in part in the description which follows and, in part, will be obvious from the description, or may be learned by practice of the general inventive concept.

The foregoing and/or other aspects of the present general inventive concept may be achieved by providing an ion print head to form an electrostatic latent image on an insulation layer of an electrostatic drum by selectively applying charged particles to the insulation layer. The ion print head includes at least one discharge cell provided with a plurality of discharge elements to emit the charged particles, and each of the discharge elements includes a base, a microelectrode disposed on the base to emit the charged particles toward the insulation layer, and a control electrode spaced apart from the base and having a hole therein through which the emitted charged particles pass and to control the emission of the charged particles from the microelectrode. The ion print head further includes a controller to control the plurality of discharge elements of the at least one discharge cell.

The foregoing and/or other aspects of the present general inventive concept may also be achieved by providing an image forming apparatus including: an electrostatic drum on which a latent image is formed, an ion print head having a structure of at least one discharge cell having a base, a microelectrode, and a control electrode to form a latent image on an insulation layer of the electrostatic drum by selectively applying charged particles to the insulation layer, a development unit to apply a developer to the charged insulation layer of the electrostatic drum to form a developer image that corresponds to the latent image, a transfer unit to transfer the developer image of the electrostatic drum to a printing medium, and a fuse to fuse the transferred image on the printing medium.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
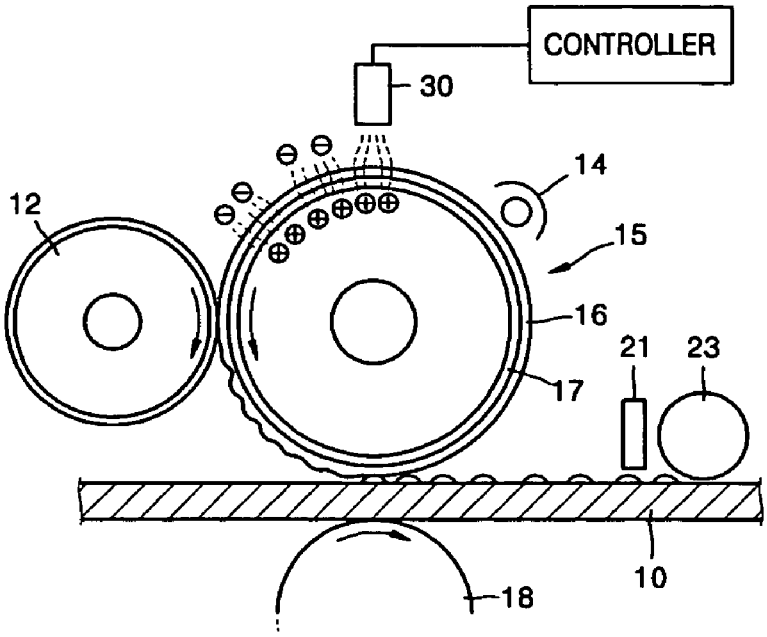
FIG. 1 (PRIOR ART)
FIG. 1 is a schematic sectional view illustrating a printer that uses a conventional ion print head.
Figure 2:
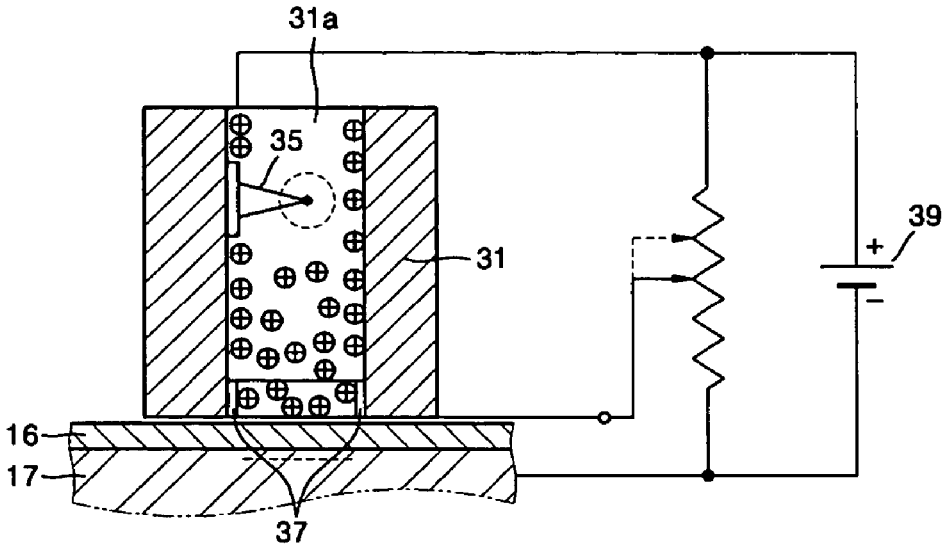
FIG. 2 (PRIOR ART)
FIG. 2 is a schematic sectional view illustrating an electronic wiring head of the conventional ion print head of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 3:
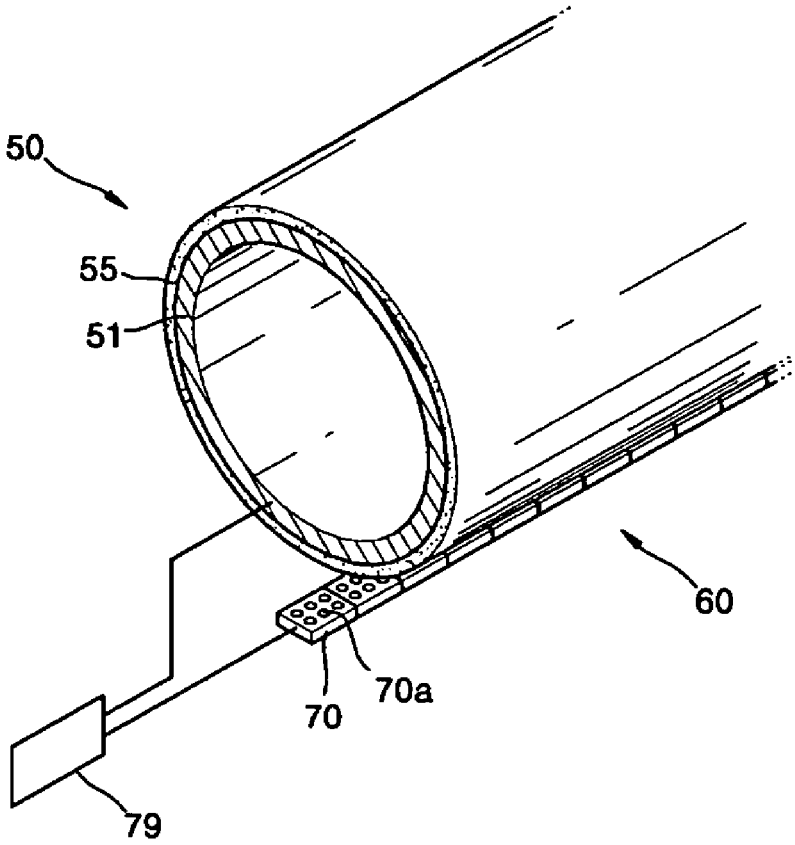
FIG. 3 is a schematic perspective view illustrating an ion print head according to an embodiment of the present general inventive concept.

FIG. 3 is a schematic perspective view illustrating an ion print head according to an embodiment of the present general inventive concept.

Referring to FIG. 3, an ion print head selectively applies charged particles on an insulation layer 55 of an electrostatic drum 50, such that the selectively charged insulation layer 55 forms a latent image. The ion print head includes a discharge cell array 60 including a discharge cell 70 (or a plurality of discharge cells 70) having a plurality of discharge elements 70*a* to emit the charged particles and a controller 79 to control the discharge elements 70*a*. The ion print head may include the discharge cell array 60 including a plurality of groups of discharge cells 70 each having a plurality of discharge cells 70 in one or more directions.

The electrostatic drum 50 includes a conductor 51 and the insulation layer 55 coated on an outer surface of the conductor 51. The conductor 51 provides electric stability for the electrostatic drum 50 and lowers sensitivity of the electrostatic drum 50 against humidity, temperature, etc. Additionally, the conductor 51 receives a bias voltage from the controller 79 to form an electric field. The insulation layer 55 holds the charged particles that are selectively applied by the ion print head on a surface thereof.

Figure 4:
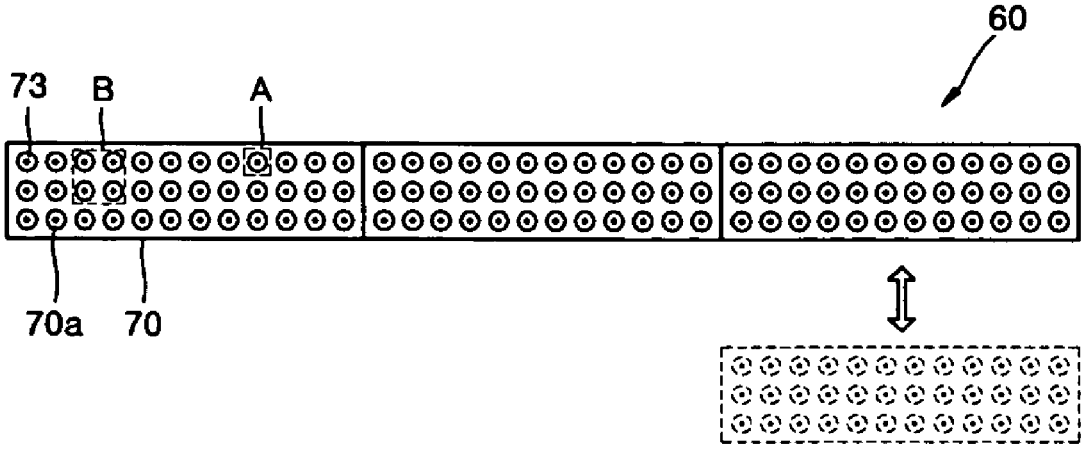
FIG. 4 is a schematic plain view illustrating a discharge cell array of the ion print head of FIG. 3.

FIG. 4 is a schematic plain view illustrating the discharge cell array 60 of the ion print head of FIG. 3.

Referring to FIGS. 3 and 4, the discharge cell 70 having the plurality of discharge elements 70*a* may include a plurality of discharge cells 70. The discharge cells 70 are arranged in a longitudinal direction of the electrostatic drum 50 to form the discharge cell array 60. Each of the discharge cells 70 independently emits the charged particles toward a corresponding surface portion of the electrostatic drum 50 to form the latent image (i.e., an electrostatic latent image) on the electrostatic drum 50. The plurality of discharge elements 70*a* of each of the discharge cells 70 may be arranged in both the longitudinal and transverse directions of the electrostatic drum 50 to form a multi-line latent image at a particular time. In other words, the discharge elements 70*a* of each of the discharge cells 70 may be arranged in two dimensions to be capable of forming more than one line of the latent image at the particular time (i.e., at one time).

Further, each of the discharge cells 70 may be replaced independently such that the discharge cell array 60 can be easily formed, replaced, and repaired. The controller 79 and the discharge cell array 60 are electrically connected. Herein, the electrical connection is constructed such that each of the discharge cells 70 can be replaced independently. A detailed description of the electrical connection will not be provided, since electrical connections should be well known to one skilled in the art.

Figure 5:
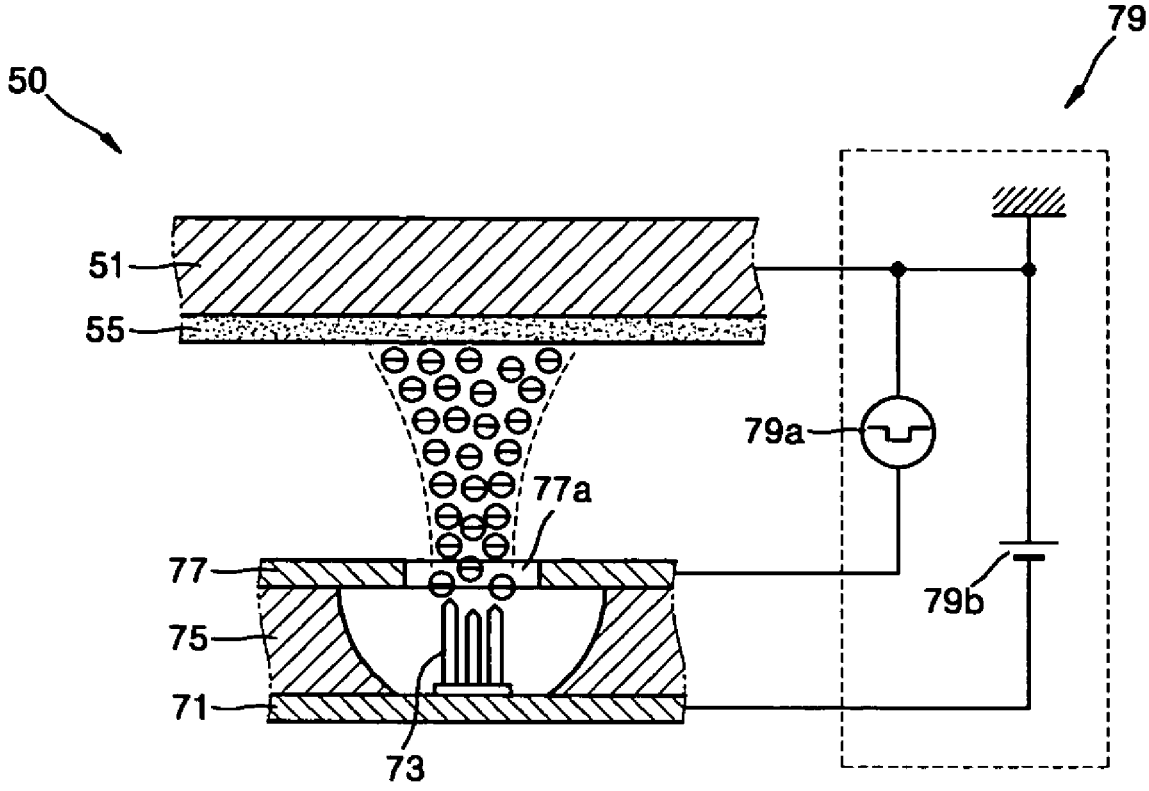
FIG. 5 is a schematic sectional view illustrating a discharge element of the ion print head of FIG. 3.

FIG. 5 is a schematic sectional view illustrating a discharge element 70*a* of the ion print head of FIG. 3.

Referring to FIGS. 4 and 5, each of the discharge elements 70*a* of the discharge cell 70 includes a base 71, a microelectrode 73, and a control electrode 77 spaced above the base 71. Additionally, a spacer 75 is disposed between the base 71 and the control electrode 77 to provide a space therebetween.

The microelectrode 73 is disposed on the base 71 and between the spacer 75 to emit charged particles toward the insulation layer 55 of the electrostatic drum 50. Although an emission of negatively charged particles is illustrated in FIG. 5, it should be understood that the polarity of the charged particles can be controlled to have a positive or a negative charge by adjusting a voltage applied by the controller 79. Herein, a polarity of a developer (e.g., toner or ink) can determine the polarity of the charged particles.

The microelectrode 73 may have an aspect ratio (H/W) that satisfies the equation below in order to maximize an electric field around an end of the microelectrode 73.

$$H/W=10 \quad \text{[Equation]}$$

where H and W represent a height and a width of the microelectrode 73, respectively.

A large aspect ratio enables the microelectrode 73 to create a high electric field around the end thereof, thereby ionizing surrounding air. The microelectrode 73 may have a rod, a pyramid, or a needle shape that has a large aspect ratio. FIG. 5 illustrates the microelectrode 73 having the needle shape.

Further, the microelectrode 73 may be made of a carbon nanotube, silicon, molybdenum, gallium arsenide, or diamond, which can easily generate ions through a corona discharge. Also, it can be appreciated that the ion print head may include one or more microelectrodes extending from the base toward the hole of the control electrode. Additionally, one or more microelectrodes may include first and second microelectrodes having different lengths.

The control electrode 77 is spaced apart from the base 71 by the spacer 75 to control the charge particle emission of the microelectrode 73. The charge particles are emitted by the electric field formed between the microelectrode 73 and the control electrode 77 according to the control exerted by the controller 79.

The control electrode 77 includes a hole 77*a* through which the charged particles pass. A spreading angle at which the charged particles are projected toward the electrostatic drum 50 is determined according to a size of the hole 77*a*. That is, a smaller hole makes the spreading angle of the charged particles smaller, which can be used for a high-resolution printing operation. Additionally, the controller 79 is capable of applying a voltage to each of the discharge elements 70*a* independently.

The controller 79 includes a control power supply 79*a* to supply a control voltage of a predetermined waveform to the control electrode 77, and a bias power supply 79*b* to supply a bias voltage to the conductor 51 of the electrostatic drum 50 and the microelectrode 73 through the base 71 thereof. An amount of the charged particles is controlled by adjusting one or more properties and an application time of the control voltage. The bias voltage supplied to the electrostatic drum 50 and the microelectrode 73 increases a speed of the charged particle emission after the control voltage is supplied to the control electrode 77, thereby reducing time required to form the latent image on the electrostatic drum 50.

In the ion print head of various embodiments of the present general inventive concept, one discharge element 70*a* can be used to form one unit pixel, or a combination of discharge elements 70*a* can be used to form one unit pixel (See unit pixels A and B in FIG. 4).

Operation of the ion print head according to an embodiment of the present general inventive concept will now be described with reference to FIGS. 3 through 5.

A voltage is applied between the microelectrode 73 and the control electrode 77, thereby forming a strong electric field around the microelectrode 73 as a result of the large aspect ratio of the microelectrode 73. The strong electric field around the microelectrode 73 ionizes surrounding air, and another electric field that is formed between the microelectrode 73 and the electrostatic drum 50 (i.e., the conductor 51) forces the ions to migrate to the insulation layer 55 of the electrostatic drum 50, thereby forming the latent image on the insulation layer 55. Herein, each control electrode 77 of the discharge elements 70*a* of the discharge cell 70 and the discharge cell array 60 can be provided with the control voltage independently such that the control voltage can be turned on or off according to image signals that correspond to the discharge elements 70*a* that are provided to the controller 79. Therefore, the amount of the charged particles to be applied on the electrostatic drum 50 can be controlled using the control electrode 77 and thus an intensity (and resolution) of the latent image can also be controlled. For example, when ten thousand discharge elements 70*a* are arranged in one line in a widthwise direction of an A4 size print medium, a resolution of 600 dpi (dots per inch) is obtained by using two discharge elements 70*a* for one unit pixel. Similarly, a resolution of 1200 dpi is obtained by using one discharge element 70*a* for one unit pixel. In this manner, printing can be performed with desired resolutions. Additionally, the discharge elements 70*a* can be arranged in matrix form (two-dimensional) to form a plurality of lines of the latent image at a particular time (i.e., at one time) to increase printing speed.

Figure 6:
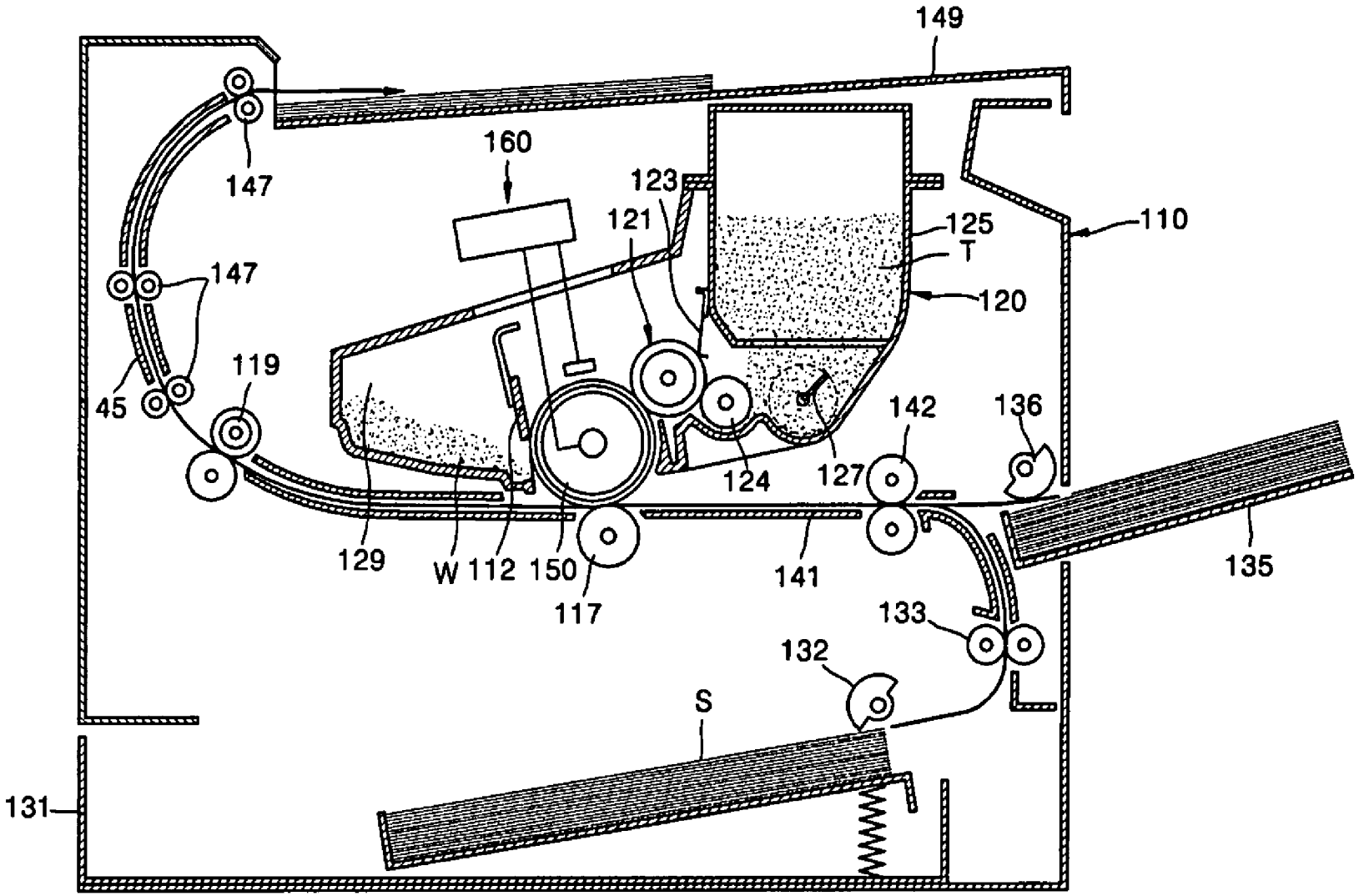
FIG. 6 is a schematic view illustrating an image forming apparatus employing an ion print head according to an embodiment of the present general inventive concept.

FIG. 6 is a schematic view illustrating an image forming apparatus employing an ion print head according to an embodiment of the present general inventive concept.

Referring to FIG. 6, the image forming apparatus includes a frame 110, an electrostatic drum 150 provided in the frame 110, an ion print head 160, a development unit 120, a transfer roller 117, and a fusing roller 119.

An electrostatic latent image that corresponds to an image to be printed on a printing medium (S) is formed on the electrostatic drum 150 by the ion print head 160. The electrostatic drum 150 and the ion print head 160 may have the same structure illustrated in FIGS. 3 through 5. Thus, descriptions of the electrostatic drum 150 and the ion print head 160 will not be provided.

The development unit 120 includes a container 125 to contain a developer (T), an agitator 127, a feed roller 124, and a development roller 121. The developer (T) of the container 125 is moved by the agitator 127, the feed roller 124, and the development roller 121 to the electrostatic latent image of the electrostatic drum 150 to form an image. According to electrophotography, the development roller 121 is supplied with a DC voltage from a power supply to apply the developer (T) to the electrostatic latent image of the electrostatic drum 150. A regulating blade 123 is abutted on an outer surface of the development roller 121 to regulate the applied developer (T). In order words, the developer (T) on the development roller 121 has a uniform thickness after it passes between the regulating blade 123 and the development roller 121. In addition, the development unit 120 is provided with a waste developer collector 129 to store a waste developer (W) that is collected from the electrostatic drum 150 by a cleaning blade 112 after the developing process.

The image formed on the electrostatic drum 150 by the development unit 120 is transferred to the printing medium (S) that passes between the electrostatic drum 150 and the transfer roller 117. The transferred image of the printing medium (S) is then fused by the fusing roller 119.

Further, the image forming apparatus includes a first cassette 131 and a second cassette 135 that hold the printing medium (S), a feed passage 141 along which the printing medium (S) is fed, and an output passage 45 along which the printing medium (S) is output after printing. Along the feed passage 141, the image forming apparatus also includes pick-up rollers 132 and 136 to pick up the printing medium (S) one by one, a feed roller 133 to guide and feed the picked up printing medium (S), and a registration roller 142 to feed the printing medium (S) for printing the image to a desired area of the printing medium (S). Along the output passage 45, the image forming apparatus also includes the fusing roller 119 and a plurality of ejection rollers 147.

Therefore, the transfer roller 117 transfers the image of the electrostatic drum 150 to the printing medium (S), which is fed along the feed passage 141 from the first cassette 131 or the second cassette 135. The transferred image is then fused by the fusing roller 119 to the printing medium (S). The printing medium (S) is then conveyed along the output passage 45 and is ejected to an output tray 149 provided at a top of the frame 110, thereby completing a printing process.

As described above, an ion print head according to various embodiments of the present general inventive concept employs a discharge cell array structure using a microelectrode such that the ion print head has a simple structure to form a latent image on an electrostatic drum. Additionally, each discharge cell of the discharge cell array can be replaced independently such that maintenance of the discharge cell array can be easily performed.

Further, an image forming apparatus employing an ion print head according to the various embodiments of the present general inventive concept does not require a light scanning unit and a charger necessary to charge an electrostatic drum such that the image forming apparatus can be simply constructed. Additionally, the electrostatic drum merely requires a conductor and an insulation layer capable of holding charged particles such that the electrostatic drum can be more easily fabricated and can have an enhanced electric field that is influenced less by humidity and temperature when compared to a photoconductive drum of the conventional art.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ion print head to form an electrostatic latent image on an insulation layer of an electrostatic drum by selectively applying charged particles to the insulation layer, the ion print head comprising:

at least one discharge cell provided with a plurality of discharge elements to emit the charged particles, and each discharge element including:

a base, a microelectrode disposed on the base to emit the charged particles toward the insulation layer, and a control electrode spaced apart from the base and having a hole therein through which the emitted charged particles pass and to control the emission of the charged particles from the microelectrode, a spacer disposed between the base and the control electrode, wherein a length of the one or more microelectrodes is shorter than a width of the spacer; and a controller to control the plurality of discharge elements of the at least one discharge cell.

2. The ion print head of claim 1, wherein the microelectrode satisfies a following condition:

$$H/W \geqq 10$$

where H and W represent a height and a width of the microelectrode, respectively.

3. The ion print head of claim 1, wherein the microelectrode is formed to have a rod, a pyramid, or a needle shape.

4. The ion print head of claim 1, wherein the microelectrode comprises a material selected from a group including carbon nanotube, silicon, molybdenum, gallium arsenide, and diamond.

5. The ion print head of claim 1, wherein the controller comprises a bias power supply to supply a bias voltage to the at least one discharge cell and the electrostatic drum, and a control power supply to supply a control voltage of a predetermined waveform to the control electrode of each of the plurality of discharge elements.

6. The ion print head of claim 5, wherein an amount of the charged particles to be applied to the electrostatic drum is controlled by adjusting one or more properties and an application time of the control voltage.

7. The ion print head of claim 1, wherein each of the plurality of discharge elements or a combination of the plurality of discharge elements corresponds to a unit pixel of the electrostatic latent image.

8. The ion print head of claim 1, wherein the at least one discharge cell comprises a plurality of discharge cells, and the plurality of discharge cells are arranged in a longitudinal direction of the electrostatic drum to form a discharge cell array.

9. The ion print head of claim 8, wherein each of the plurality of discharge cells of the discharge cell array are independently replaceable.

10. The ion print head of claim 8, wherein each of the plurality of discharge cells of the discharge cell array independently emits the charged particles toward a corresponding area of the electrostatic drum to form the electrostatic latent image.

11. The ion print head of claim 1, wherein the electrostatic drum comprises a conductor and the insulation layer coated on an outer surface of the conductor.

12. An ion print head usable with an image forming apparatus, comprising:

a discharge cell array comprising a plurality of discharge elements to emit charged particles to create a latent image on an electrostatic drum, wherein each of the plurality of discharge elements comprises a base and a microelectrode disposed on the base to face the electrostatic drum and each includes a control electrode disposed between the microelectrode and the electrostatic drum, a spacer disposed between the base and the control electrode, wherein a length of the one or more microelectrodes is shorter than a width of the spacer.

13. The ion print head of claim 12, wherein the discharge cell array includes a plurality of discharge cells each including a plurality of discharge elements.

14. The ion print head of claim 13, wherein each of the plurality of discharge cells comprise two or more rows of discharge elements such that two or more lines of the latent image can be formed at one time.

15. The ion print head of claim 13, wherein the plurality of discharge cells are arranged longitudinally along a length of the electrostatic drum to emit the charged particles to corresponding portions of the electrostatic drum.

16. The ion print head of claim 13, wherein the plurality of discharge cells are independently replaceable and independently controllable.

17. The ion print head of claim 12, wherein each control electrode has an opening therein through which the charged particles flow from the microelectrode to a surface of the electrostatic drum.

18. The ion print head of claim 12, wherein each of the plurality of discharge elements further comprise a control unit to provide a bias voltage between the electrostatic drum and the base and to provide a switching control voltage to the control electrode.

19. The ion print head of claim 18, wherein the bias voltage creates an electric field between the microelectrode and the electrostatic drum such that gas molecules surrounding the microelectrode are ionized and the charged particles flow toward the electrostatic drum due to the created electric field, and the switching control voltage applied to the control electrode controls a flux of the charged particles through the opening in the control electrode.

20. The ion print head of claim 18, wherein the control voltage is selectively applied to the discharge elements to turn the discharge elements on and off.

21. The ion print head of claim 12, wherein the microelectrode projects from the base toward the electrostatic drum and has a large aspect ratio and comprises one of a pyramid shape, a needle shape, and a rod shape.

22. The ion print head of claim 12, wherein a unit pixel is formed by a predetermined number of discharge elements according to a desired resolution.

23. An ion print head usable with an image forming apparatus, comprising:

a discharge cell having a base, a control electrode spaced apart from the base and having a hole, and one or more microelectrodes extending from the base toward the hole of the control electrode; and a spacer disposed between the base and the control electrode, wherein a length of the one or more microelectrodes is shorter than a width of the spacer.

24. The ion print head of 23, wherein the spacer comprises a first area corresponding to the one or more microelectrodes and a second area corresponding to the hole, and the first area is smaller than the second area.

25. The ion print head of claim 23, wherein the spacer comprises a first portion contacting the base and a second portion contacting the control electrode to form a space to accommodate the one or more microelectrodes, and the second portion is wider than the first portion.

26. The ion print head of claim 23, wherein the one or more microelectrodes comprise first and second microelectrodes having different lengths.

27. An image forming apparatus, comprising:

an electrostatic drum on which a latent image is formed;

an ion print head to form the latent image on an insulation layer of the electrostatic drum by selectively applying charged particles to the insulation layer, the ion print head comprising:

at least one discharge cell provided with a plurality of discharge elements to emit the charged particles, and each discharge element including a base, a microelectrode disposed on the base to emit the charged particles toward the insulation layer, and a control electrode spaced apart from the base and having a hole therein through which the emitted charged particles pass and to control the emission of the charged particles from the microelectrode, a spacer disposed between the base and the control electrode, wherein a length of the one or more microelectrodes is shorter than a width of the spacer, and a controller to control the plurality of discharge elements of the at least one discharge cell;

a development unit to apply a developer to the charged insulation layer of the electrostatic drum to form a developer image that corresponds to the latent image;

a transfer unit to transfer the developer image of the electrostatic drum to a printing medium; and a fuser to fuse the transferred image on the printing medium.

28. The image forming apparatus of claim 27, wherein the microelectrode satisfies a following condition:

$$H/W \geqq 10$$

where H and W represent a height and a width of the microelectrode, respectively.

29. The image forming apparatus of claim 27, wherein the microelectrode is formed to have a rod, a pyramid or a needle shape.

30. The image forming apparatus of claim 27, wherein the microelectrode comprises a material selected from a group including carbon nanotube, silicon, molybdenum, gallium arsenide, and diamond.

31. The image forming apparatus of claim 27, wherein the controller comprises a bias power supply to supply a bias voltage to the at least one discharge cell and the electrostatic drum, and a control power supply to supply a control voltage of a predetermined waveform to the control electrode of each of the plurality of discharge elements.

32. The image forming apparatus of claim 31, wherein an amount of the charged particles to be applied to the electrostatic drum is controlled by adjusting one or more properties and an application time of the control voltage.

33. The image forming apparatus of claim 27, wherein each of the plurality of discharge elements or a combination of the plurality of discharge elements corresponds to a unit pixel of the latent image.

34. The image forming apparatus of claim 27, wherein the at least one discharge cell comprises a plurality of discharge cells and the plurality of discharge cells are arranged in a longitudinal direction of the electrostatic drum to form a discharge cell array.

35. The image forming apparatus of claim 34, wherein each of the plurality of discharge cells of the discharge cell array is independently replaceable.

36. The image forming apparatus of claim 34, wherein each of the plurality of discharge cells of the discharge cell array independently emits the charged particles toward a corresponding area of the electrostatic drum to form the latent image.

37. The image forming apparatus of claim 27, wherein the electrostatic drum comprises a conductor and the insulation layer coated on an outer surface of the conductor.

38. An image forming unit of an image forming apparatus, comprising:

an electrostatic drum including a conductor and an insulating layer disposed around the conductor; and a discharge cell array extending along a length of the electrostatic drum to form a latent image on the insulating layer of the electrostatic drum and including a plurality of discharge elements arranged in two dimensions to form at least two lines of the latent image at one time.

39. An image forming unit of an image forming apparatus, comprising:

an electrostatic drum including a conductor and an insulating layer disposed around the conductor; and a plurality of discharge elements arranged along a length of the electrostatic drum to form a latent image thereon and each discharge element including a base disposed opposite the insulating layer of the electrostatic drum and a microelectrode extending from the base and perpendicular to the length of the electrostatic drum to ionize surrounding air.

40. An image forming unit, comprising:

an ion print head including a discharge cell having a base, a control electrode spaced apart from the base and having a hole, and one or more microelectrodes extending from the base toward the hole of the control electrode; and a spacer disposed between the base and the control electrode, wherein a length of the one or more microelectrodes is shorter than a width of the spacer.

41. The image forming unit of claim 40, wherein the spacer comprises a first area corresponding to the one or more microelectrodes and a second area corresponding to the hole, and the first area is smaller than the second area.

42. The image forming unit of claim 40, wherein the spacer comprises a first portion contacting the base and a second portion contacting the control electrode to form a space to accommodate the one or more microelectrodes, and the second portion is wider than the first portion.

43. The image forming unit of claim 40, wherein the one or more microelectrodes comprise first and second microelectrodes having different lengths.

44. A method of an ion print head, the method comprising:

creating a constant electrostatic potential across a gap between an electrostatic drum and at least one discharge element having a base;

emitting charge particles from at least one microelectrode projecting from the at least one discharge element toward the electrostatic drum; and controlling a flow of charged particles through a hole in a corresponding at least one control electrode disposed between the at least one microelectrode and the electrostatic drum by applying a varying electrostatic potential thereto, wherein a spacer is disposed between the base and the microelectrode, and wherein a length of the at least one microelectrode is shorter than a width of the spacer.

45. The method of claim 44, wherein the at least one discharge element comprises a plurality of discharge elements arranged in two dimensions, and the method further comprises:

forming a plurality of lines of a latent image on the electrostatic drum at one time.

* * * * *